US009038716B2

(12) United States Patent
Briquet et al.

(10) Patent No.: US 9,038,716 B2
(45) Date of Patent: May 26, 2015

(54) FLUID CONTROL MODULES FOR USE WITH DOWNHOLE TOOLS

(75) Inventors: Stephane Briquet, Houston, TX (US); Mark Milkovisch, Cypress, TX (US); Scott Dyas, Houston, TX (US); Wade W. Evans, II, Rosenberg, TX (US); Kevin Zanca, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 926 days.

(21) Appl. No.: 12/478,819

(22) Filed: Jun. 5, 2009

(65) Prior Publication Data

US 2010/0307769 A1 Dec. 9, 2010

(51) Int. Cl.
*E21B 49/10* (2006.01)

(52) U.S. Cl.
CPC ..... *E21B 49/10* (2013.01)

(58) Field of Classification Search
CPC ..... E21B 49/10; E21B 49/081
USPC ..... 166/264; 73/152.23, 152.24, 152.18
See application file for complete search history.

(56) References Cited

U.S. PATENT DOCUMENTS

| | | | | |
|---|---|---|---|---|
| 4,402,910 | A * | 9/1983 | Smith et al. | 422/83 |
| 4,860,580 | A * | 8/1989 | DuRocher | 73/152.26 |
| 6,719,049 | B2 * | 4/2004 | Sherwood et al. | 166/264 |
| 7,140,436 | B2 * | 11/2006 | Grant et al. | 166/264 |
| 7,178,591 | B2 | 2/2007 | Del Campo et al. | |
| 2008/0245569 | A1 * | 10/2008 | Nold et al. | 175/24 |
| 2009/0025926 | A1 | 1/2009 | Briquet et al. | |

* cited by examiner

*Primary Examiner* — Shane Bomar
*Assistant Examiner* — Kipp Wallace
(74) *Attorney, Agent, or Firm* — Kenneth L. Kincaid; Cathy Hewitt

(57) ABSTRACT

Downhole tool fluid flow control apparatus including a first fluid valve between a first portion of a first flowline and a second portion of a second flowline. The first and second flowlines are adjacent each other. A second fluid valve is between a second portion of the first flowline and a first portion of the second flowline. The first and second fluid valves are controllable to cause fluid flow between the first portion of the first flowline and the second portion of the second flowline or between the first portion of the second flowline and the second portion of the first flowline.

25 Claims, 9 Drawing Sheets

FLUID CONTROL MODULES FOR USE WITH DOWNHOLE TOOLS

BACKGROUND

Downhole fluid analysis is often used to provide information in real time about the composition of subterranean formation or reservoir fluids. Such real-time information can be used to improve or optimize the effectiveness of formation testing tools during sampling processes in a given well (e.g., downhole fluid composition analysis allows for reducing and/or optimizing the number of samples captured and brought back to the surface for further analysis). More generally, collecting accurate data about the characteristics of formation fluid(s) is an important aspect of making reliable predictions about a formation or reservoir and, thus, can have a significant impact on reservoir performance (e.g., production, quality, volume, efficiency, etc.). Generally, characteristics of formation fluid(s) may be measured using various sensors that are deployed via wireline tools and/or logging-while-drilling (LWD) tools. However, because of the limited available space, the number of sensors positionable within wireline tools and/or LWD tools is limited, which can also limit the amount or variety of data that can be collected.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Certain examples are shown in the above-identified figures and described in detail below. In describing these examples, like or identical reference numbers may be used to identify the same or similar elements. Additionally, several examples have been described throughout this specification. Any features from any example may be included with, a replacement for, or otherwise combined with other features from other examples.

The example methods and apparatus described herein may be used to control the flow of fluid in a downhole environment through and between flowlines disposed within a downhole tool. Such an approach enables the examples described herein to divert the flow of fluid in response to an operational problem in or otherwise associated with a portion of either of the flowlines and/or to obtain a greater number and/or variety of measurements from fluid flowing through the flowlines without increasing the overall number of sensors positioned within the downhole tool.

In accordance with one or more aspects of the present disclosure, a plurality of fluid valves may be fluidly coupled along or between first and second flowlines disposed adjacent and/or proximate one another within a downhole tool or a module of the downhole tool. Additionally, a first sensor may be coupled to the first flowline and a second sensor may be coupled to the second flowline. In operation, the plurality of fluid valves may be actuated to enable fluid flowing from a first portion of the first flowline to flow to either a second portion of the first flowline or a second portion of the second flowline, thereby enabling measurements of the fluid flowing from the first portion of the first flowline to be obtained via the first sensor or the second sensor. Similarly, the plurality of fluid valves may be actuated to enable fluid flowing from a first portion of the second flowline to flow to either a second portion of the second flowline or a second portion of the first flowline, thereby enabling measurements of the fluid flowing from the first portion of the second flowline to be obtained via the first sensor or the second sensor. Additionally or alternatively, the plurality of fluid valves may be actuated to bypass a portion of either of the flowlines in response to an operational problem with a device (e.g., sensor) coupled to one of the flowlines, to isolate a portion of a toolstring and/or to bypass another type of problem (e.g., a leak, a clog, etc.) in one of the flowlines.

Figure 1A:
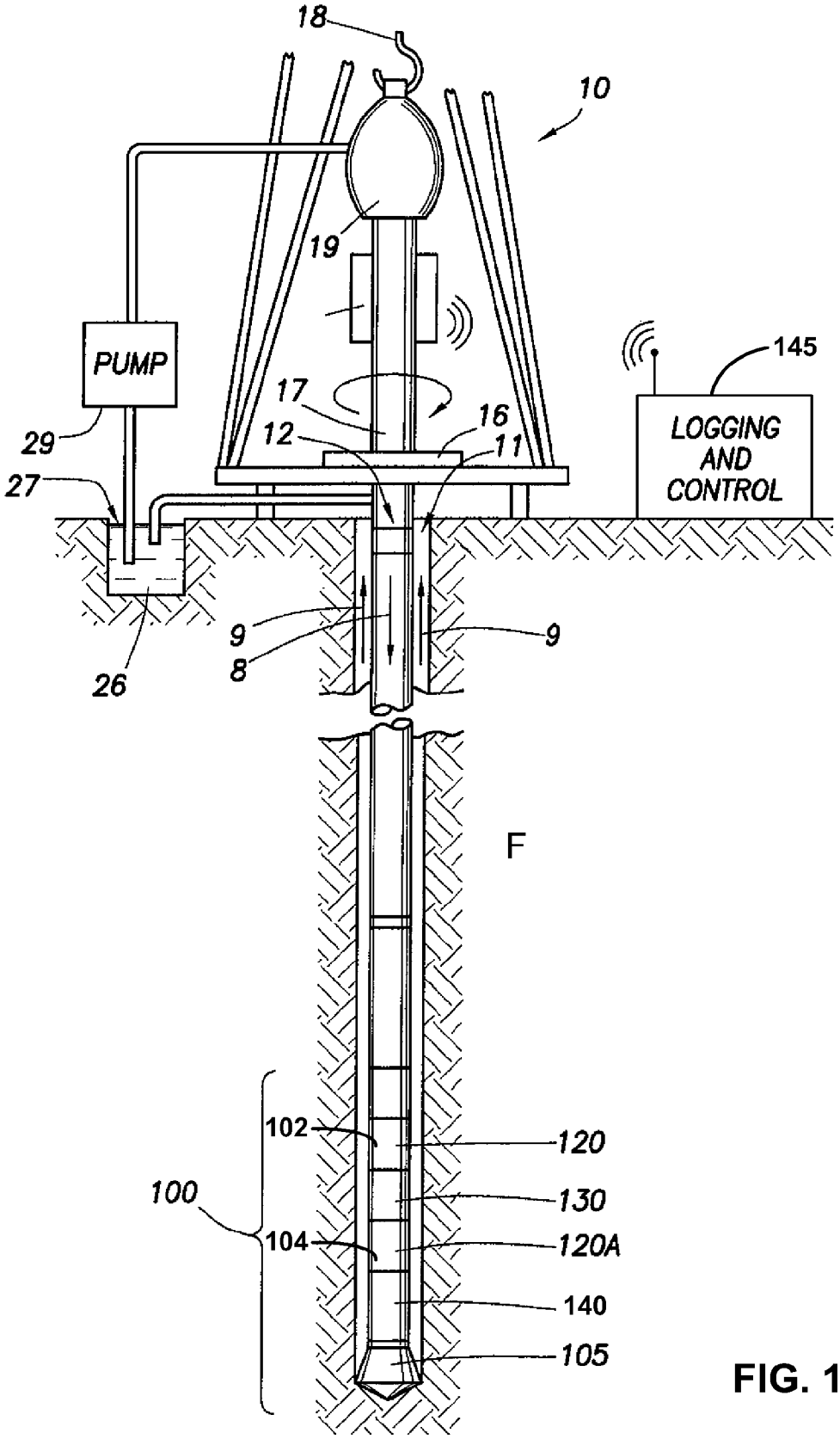
FIG. 1A is a schematic view of an example wellsite drilling system.

FIG. 1A illustrates an example wellsite drilling system that can be employed onshore and/or offshore and which may implement the example fluid control modules described herein. In the example wellsite system of FIG. 1A, a borehole 11 is formed in one or more subsurface formations by rotary and/or directional drilling.

As illustrated in FIG. 1A, a drillstring 12 is suspended in the borehole 11 and has a bottomhole assembly (BHA) 100 having a drill bit 105 at its lower end. A surface system includes a platform and derrick assembly 10 positioned over the borehole 11. The derrick assembly 10 includes a rotary table 16, a kelly 17, a hook 18 and a rotary swivel 19. The drillstring 12 is rotated by the rotary table 16, energized by means not shown, which engages the kelly 17 at an upper end of the drillstring 12. The example drillstring 12 is suspended from the hook 18, which is attached to a traveling block (not shown), and through the kelly 17 and the rotary swivel 19, which permits rotation of the drillstring 12 relative to the hook 18. Additionally or alternatively, a top drive system could be used.

In the example depicted in FIG. 1A, the surface system further includes drilling fluid 26, which is commonly referred to in the industry as mud, which is stored in a pit 27 formed at the well site. A pump 29 delivers the drilling fluid 26 to the interior of the drillstring 12 via a port in the rotary swivel 19, causing the drilling fluid 26 to flow downwardly through the drillstring 12 as indicated by the directional arrow 8. The drilling fluid 26 exits the drillstring 12 via ports in the drill bit 105, and then circulates upwardly through the annulus region between the outside of the drillstring 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) (e.g., filter cake) on the walls of the borehole 11.

The example bottomhole assembly 100 of FIG. 1A includes, among other things, any number and/or type(s) of logging-while-drilling (LWD) modules or tools (two of which are designated by reference numerals 120 and 120A) and/or measuring-while-drilling (MWD) modules (one of which is designated by reference numeral 130), a rotary-steerable system or mud motor 140 and the example drill bit 105. The MWD module 130 measures the drill bit 105 azimuth and inclination that may be used to monitor the borehole trajectory.

The example LWD tools 120 and 120A of FIG. 1A are housed in respective drill collars 102 and 104, which may contain any number of logging tools and/or fluid sampling devices. The example LWD tools 120 and 120A include capabilities for measuring, processing and/or storing information, as well as for communicating with the MWD module 130 and/or directly with the surface equipment, such as, for example, a logging and control computer 145.

The logging and control computer 145 may include a user interface that enables parameters to be input and/or outputs to be displayed. While the logging and control computer 145 is depicted uphole and adjacent the wellsite system, a portion or all of the logging and control computer 145 may be positioned in the bottomhole assembly 100 and/or in a remote location.

Figure 1B:
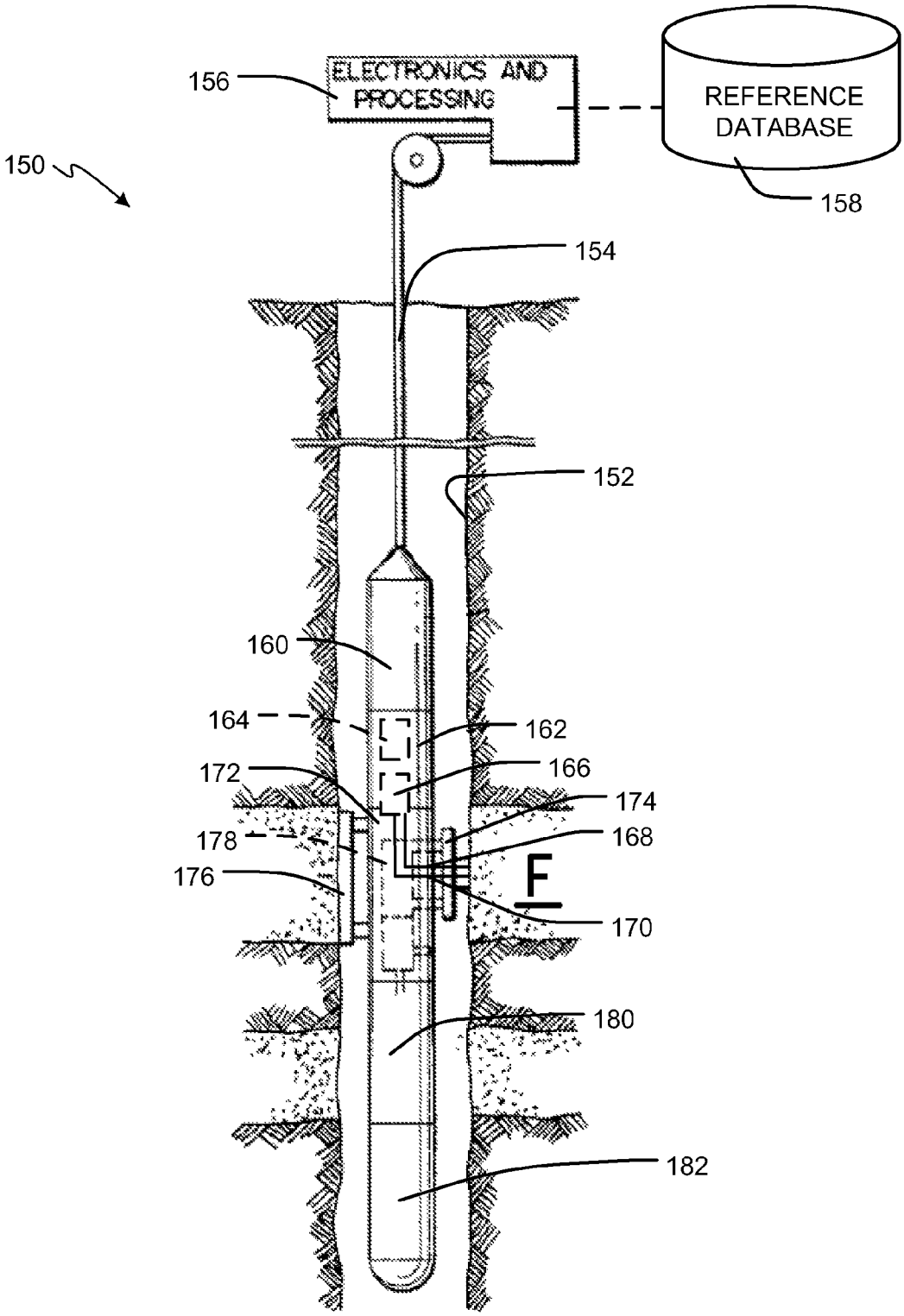
FIG. 1B is a schematic view of an example wireline tool.

FIG. 1B depicts an example wireline tool 150 that may be used to extract and analyze formation fluid samples and which may implement the example fluid control modules described herein. Specifically, the example wireline tool 150 may be used to analyze formation fluid samples by, for example, selectively controlling fluid flow through the wireline tool 150.

As shown in FIG. 1B, the example wireline tool 150 is suspended in a borehole or wellbore 152 from the lower end of a multiconductor cable 154 that is spooled on a winch (not shown) at the surface. At the surface, the cable 154 is communicatively coupled to an electronics and processing system 156. The electronics and processing system 156 may include or be communicatively coupled to a database 158 (e.g., a memory module) that may be used to store measurement values obtained using the examples described herein. The wireline tool 150 includes an elongated body 160 that includes a collar 162 having a downhole control system 164 configured to control extraction of formation fluid from a formation F, perform measurements on the extracted fluid and/or to control the apparatus described herein to control fluid flow though the wireline tool 150. Specifically, the downhole control system 164 may control an example module 166 that controls a flow of fluid through and/or between a first flowline 168 and a second flowline 170, as described in more detail below.

The example wireline tool 150 also includes a formation tester 172 having a selectively extendable fluid admitting assembly 174 and a selectively extendable tool anchoring member 176 that are respectively arranged on opposite sides of the elongated body 160. The fluid admitting assembly 174 is configured to selectively seal off or isolate selected portions of the wall of the wellbore 152 to fluidly couple to the adjacent formation F and draw fluid samples from the formation F. The formation tester 172 also includes a fluid analysis module 178 through which the obtained fluid samples flow. The sample fluid may thereafter be expelled through a port (not shown) or it may be sent to one or more fluid collecting chambers 180 and 182, which may receive and retain the formation fluid samples for subsequent testing at the surface or a testing facility.

In the illustrated example, the electronics and processing system 156 and/or the downhole control system 164 are configured to control the fluid admitting assembly 174 to draw fluid samples from the formation F and to control the fluid analysis module 178 to measure the fluid samples. In some example implementations, the fluid analysis module 178 may be configured to analyze the measurement data of the fluid samples as described herein. In other example implementations, the fluid analysis module 178 may be configured to generate and store the measurement data and subsequently communicate the measurement data to the surface for analysis at the surface. Although the downhole control system 164 is shown as being implemented separate from the formation tester 172, in some example implementations, the downhole control system 164 may be implemented in the formation tester 172.

As described in greater detail below, the example wireline tool 150 may be used in conjunction with the example methods and apparatus described herein to control a flow of fluid through and/or between the flowlines 168 and 170. For example, the formation tester 172 may include one or more sensors, fluid analyzers and/or fluid measurement units disposed adjacent the flowlines 168 and 170 and may be controlled by one or both of the downhole control system 164 and the electronics and processing system 156 to determine the composition of and/or a characteristic of fluid samples extracted from, for example, the formation F.

While the example methods and apparatus described herein are described in connection with a drillstring such as that shown in FIG. 1A and a wireline tool such as that shown in FIG. 1B, the example methods and apparatus can be implemented with any other type of wellbore conveyance.

Figure 2:
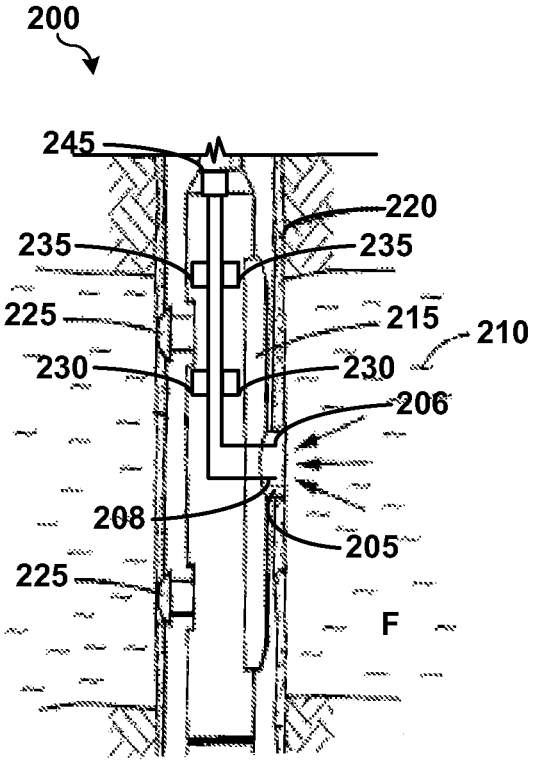
FIG. 2 is a schematic view of an example apparatus according to one of more aspects of the present disclosure.

FIG. 2 is a simplified diagram of an apparatus 200 that may be used to implement the LWD tools 120 and/or 120A and/or to implement a portion of the wireline tool 150. The example apparatus 200 of FIG. 2 is provided with a probe 205 that includes a first flowline 206 and a second flowline 208 each or both of which may be configured to establish fluid communication with the formation F and to draw fluid 210 into the apparatus 200, as indicated by arrows. The example probe 205 may be positioned, for example, within or adjacent to a stabilizer blade 215 of the apparatus 200 and extend away from the stabilizer blade 215 to engage a borehole wall 220. The example stabilizer blade 215 comprises one or more blades that are in contact with the borehole wall 220.

The fluid drawn into the apparatus 200 via the probe 205 may be measured to determine, for example, viscosity, fluid density, optical density, absorbance, etc. The apparatus 200 may comprise one or more fluid measurement units 230 and one or more sensors 235 which are collectively configured to measure parameters (e.g., process parameters, formation parameters, etc.) of fluid in the first flowline 206 and/or the second flowline 208. The fluid measurement unit(s) 230 may include a light absorption spectrometer having a plurality of channels, each of which may correspond to a different wavelength. Thus, the fluid measurement unit(s) 230 may be configured to measure spectral information for fluids drawn from the formation F contained in the first flowline 206 and/or the second flowline 208. This spectral information may be utilized to determine a composition and/or other properties of the fluid. The fluid measurement unit(s) 230 may additionally or alternatively include a near infrared (NIR) spectrometer, a resistivity measurement unit and/or any other suitable fluid measurement unit.

The sensors 235 may be configured to measure pressure, drilling fluid density, formation fluid density, formation fluid viscosity, and/or drilling fluid viscosity of fluid contained in the first flowline 206 and/or the second flowline 208. The sensors 235 may output analog and/or digital signals, which may be digitized representations of analog signals processed to reduce noise and/or processed to reduce the number of bits used to represent the output. The output may additionally or alternatively include one or more parameters derived from measured data and/or one or more sensor outputs.

The apparatus 200 may be provided with devices such as, for example, a chamber 245 for collecting fluid samples diverted from one of the flowlines 206 or 208 for retrieval at the surface. Backup pistons 225 may also be provided to assist in applying force to push the apparatus 200 and/or the probe 205 against the borehole wall 220. In other examples, the example apparatus 200 may be provided with a dual inflatable packer focus probe (not shown).

Figure 3:
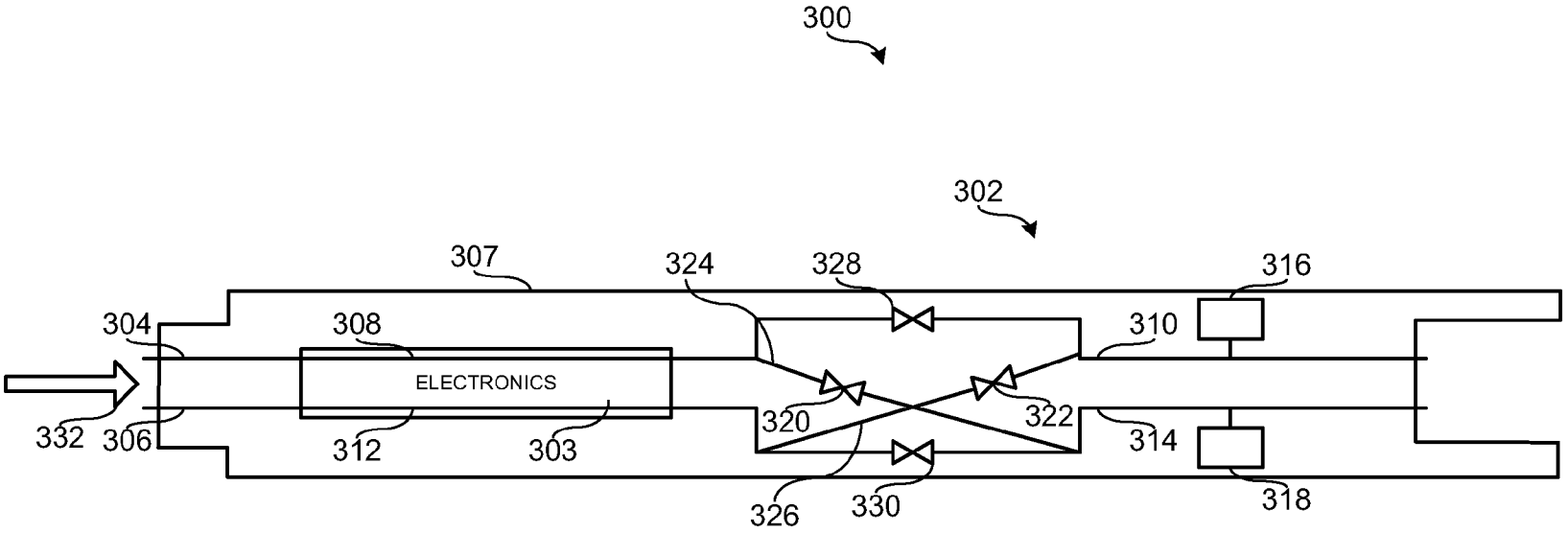
FIGS. 3-6 are block diagrams of example apparatus according to one of more aspects of the present disclosure.

FIG. 3 depicts an example apparatus or module 300 of a drillstring or wireline tool 302 that may be used to implement at least a portion of the apparatus 200 of FIG. 2. The module 300 includes an electronics module 303 and a first flowline 304 and a second flowline 306 that extend through the module 300 and which are surrounded by or housed in a body 307 of the module 300. The first and second flowlines 304 and 306 may be used to implement the first and second flowlines 206 and 208 of FIG. 2. The first flowline 304 includes a first portion 308 (e.g., an upstream portion) and a second portion 310 (e.g., a downstream portion) and, similarly, the second flowline 306 includes a first portion 312 (e.g., an upstream portion) and a second portion 314 (e.g., a downstream portion). Generally, providing the module 300 with the flowlines 304 and 306 increases the total available flow area, which may serve to increase the overall flowrate through the module 300. In this example, the first and second flowlines 304 and 306 are positioned adjacent to and substantially symmetrical relative to each other. However, the flowlines 304 and 306 may be positioned in any other suitable arrangement in the module 300.

To obtain a measurement of one or more characteristics of fluid that flows through the second portion 310 of the first flowline 304 and/or the second portion 314 of the second flowline 306, the module 300 is provided with a first sensor 316 and a second sensor 318 coupled to the respective second portions 310 and 314. The first sensor 316 and the second sensor 318 may be similarly or differently configured to measure the same fluid characteristic(s) such as, for example, pressure, resistively, density or viscosity. Alternatively, the first sensor 316 may be configured to measure a first fluid characteristic (e.g., viscosity) and the second sensor 318 may be configured to measure a second fluid characteristic (e.g., pressure).

To control the flow of fluid between the first flowline 304 and the second flowline 306, the module 300 is provided with first and second fluid valves 320 and 322, which may, for example, be configured as two-way valves that are fluidly coupled to first and second junction flowlines 324 and 326. Generally, the first junction flowline 324 enables fluid to flow from the first portion 308 of the first flowline 304 to the second portion 314 of the second flowline 306 and the second junction flowline 326 enables fluid to flow from the first portion 312 of the second flowline 306 to the second portion 310 of the first flowline 304.

To control the flow of fluid between the first and second portions 308 and 310 of the first flowline 304, the module 300 is provided with a third fluid valve 328 (e.g., another two-way valve) that is fluidly coupled between the first and second portions 308 and 310. Similarly, to control the flow of fluid between the first and second portions 312 and 314 of the second flowline 306, the module 300 is provided with a fourth fluid valve 330 (e.g., another two-way valve) that is fluidly coupled between the first and second portions 312 and 314.

In operation, fluid may flow from the formation F (FIGS. 1 and 2) through the flowlines 304 and 306 in a direction generally indicated by arrow 332. However, formation fluid may flow through the first flowline 304 and another fluid (e.g., hydrogen sulfide) may flow through the second flowline 306 in a different direction than the flow of the formation fluid.

To enable the first sensor 316 to measure a characteristic(s) of the fluid flowing from the first portion 308 of the first flowline 304, the third fluid valve 328 may be actuated to an open position and the first fluid valve 320 may be actuated to a closed position, thereby enabling the fluid to flow from the first portion 308 to the second portion 310 to which the first sensor 316 is coupled. Similarly, to enable the second sensor 318 to measure a characteristic(s) of fluid flowing from the first portion 312 of the second flowline 306, the fourth fluid valve 330 may be actuated to an open position and the second fluid valve 322 may be actuated to a closed position, thereby enabling the fluid to flow from the first portion 312 to the second portion 314 to which the second sensor 318 is coupled. Once the first sensor 316 measures a characteristic of the fluid flowing from the first portion 308 and the second sensor 318 measures a characteristic of the fluid flowing from the first portion 312, the third fluid valve 328 may be actuated to the closed position and the first fluid valve 320 may be actuated to the open position such that fluid flows from the first portion 308 of the first flowline 304 to the second portion 314 of the second flowline 306 to enable, for example, the second sensor 318 to measure a characteristic(s) of the fluid flowing from the first portion 308. Similarly, the fourth fluid valve 330 may be actuated to the closed position and the second fluid valve 322 may be actuated to the open position such that fluid flows from the first portion 312 of the second flowline 306 to the second portion 310 of the first flowline 304 to enable, for example, the first sensor 316 to measure a characteristic(s) of the fluid flowing from the first portion 312. Such an approach enables the examples described herein to obtain measurements via both of the sensors 316 and 318 from fluid flowing from each of the first portions 308 and 312. The sensor 316 and/or 318 may measure a characteristic of the fluid shortly after the respective fluid valves 320, 322, 328 and/or 330 have been actuated to determine an impact that actuating the fluid valves 320, 322, 328 and/or 330 has on the sample fluid quality.

Alternatively, for example, if the first sensor 316 malfunctions and/or encounters an operational problem that prevents it from properly measuring the characteristic of the fluid flowing through the second portion 310 of the first flowline 304, the module 300 may actuate the fluid valves 320, 322, 328 and 330 to control the flow of fluid through the module 300 to enable the second sensor 318 to measure a characteristic of the fluid flowing from the first portion 308 of the first flowline 304 or to measure a characteristic of the fluid flowing from the first portion 312 of the second flowline 306. A similar approach that bypasses at least one of the portions 308, 310, 312 and/or 314 of the module 300 may be utilized if there is a problem (e.g., a leak, a clog, etc.) in one of the portions 308, 310, 312 and/or 314. Such a bypassing operation enables the module 300 to be operational even if there is a problem with one of the portions 308, 310, 312 and/or 314. The fluid valves 320, 322, 328 and 330 may be implemented using any suitable valves that are operable under downhole conditions and may be electrically controllable or hydraulically controllable.

Figure 4:
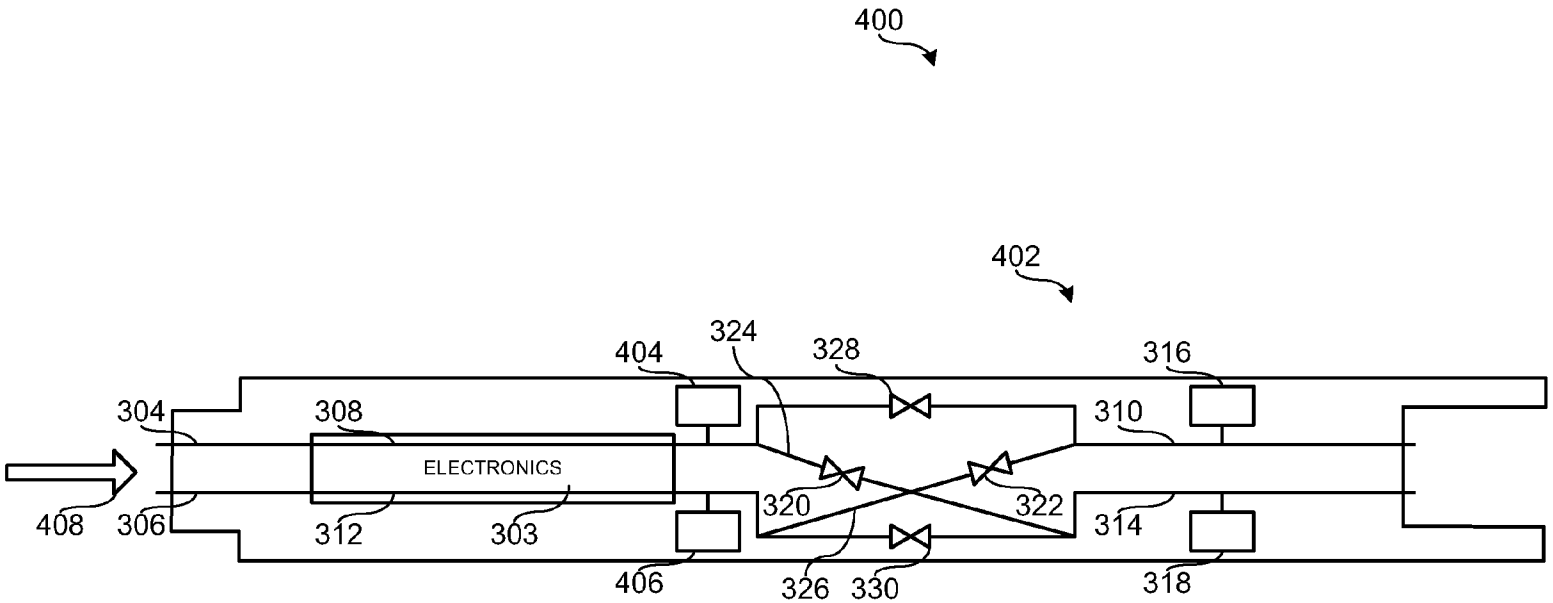

FIG. 4 depicts an example apparatus or module 400 of a drillstring or wireline tool 402 that may be used to implement at least a portion of the apparatus 200 of FIG. 2. The module 400 includes the electronics module 303 and the first flowline 304 and the second flowline 306 that extend through the module 400. As described above, the first flowline 304 includes the first portion 308 and the second portion 310 and, similarly, the second flowline 306 includes the first portion 312 and the second portion 314. In contrast to the example module 300 depicted in FIG. 3, the example module 400 additionally includes a third sensor 404 coupled to the first portion 308 of the first flowline 304 and a fourth sensor 406 coupled to the first portion 312 of the second flowline 306. While the example module 400 is depicted in FIG. 4 as including four sensors, the example module 400 may include any number of sensors (e.g., 1, 2, 3, 4, etc.) that may be similarly or differently configured to measure the same or different fluid characteristics. In some examples, the module 400 may be provided with a flowrate sensor (not shown) positioned between the first and third sensors 316 and 404 and/or between the second and fourth sensors 318 and 406.

In operation, fluid may flow from the formation F (FIGS. 1 and 2) through the flowlines 304 and 306 in a direction generally indicated by arrow 408. However, the fluid may flow through the flowlines 304 and/or 306 in a direction different than that represented by the arrow 408. As the fluid flows through the first portion 308 of the first flowline 304, the third sensor 404 may measure a characteristic of the fluid and, as the fluid flows through the second portion 310 of the first flowline 304, the first sensor 316 may measure another characteristic of the fluid, which may be the same or different from the characteristic measured by the third sensor 404. Similarly, as the fluid flows through the first portion 312 of the second flowline 306, the fourth sensor 406 may measure a characteristic of the fluid and, as the fluid flows through the second portion 314 of the second flowline 306, the second sensor 318 may measure another characteristic of the fluid, which may be the same or different from the characteristic measured by the fourth sensor 406. In some examples, the third and fourth sensors 404 and 406 may measure the pressure of the fluid or any other suitable characteristic.

As discussed above, the first fluid valve 320 and the third fluid valve 328 may be actuated to control the flow of fluid from the first portion 308 of the first flowline 304 and the second portion 310 of the first flowline 304 or the second portion 314 of the second flowline 306, thereby enabling measurements to be obtained via either the first sensor 316 and/or the second sensor 318 from the fluid flowing from the first portion 308. Similarly, the second fluid valve 322 and the fourth fluid valve 330 may be actuated to control the flow of fluid from the first portion 312 of the second flowline 306 and the second portion 314 of the second flowline 306 or the second portion 310 of the first flowline 304, thereby enabling measurements to be obtained via either the first sensor 316 and/or the second sensor 318 from the fluid flowing from the first portion 312. Such an approach enables at least three measurements to be obtained via the sensors 404, 316, and 318 or the sensors 406, 316 and 318 from the fluid flowing from each of the first portions 308 and 312 without increasing the overall number of sensors in the example module 400. Additionally or alternatively, such an approach enables at least one of the portions 308, 310, 312 and/or 314 to be bypassed if an operational problem (e.g., a leak, a clog, etc.) occurs in one of the portions 308, 310, 312 and/or 314.

Figure 5:
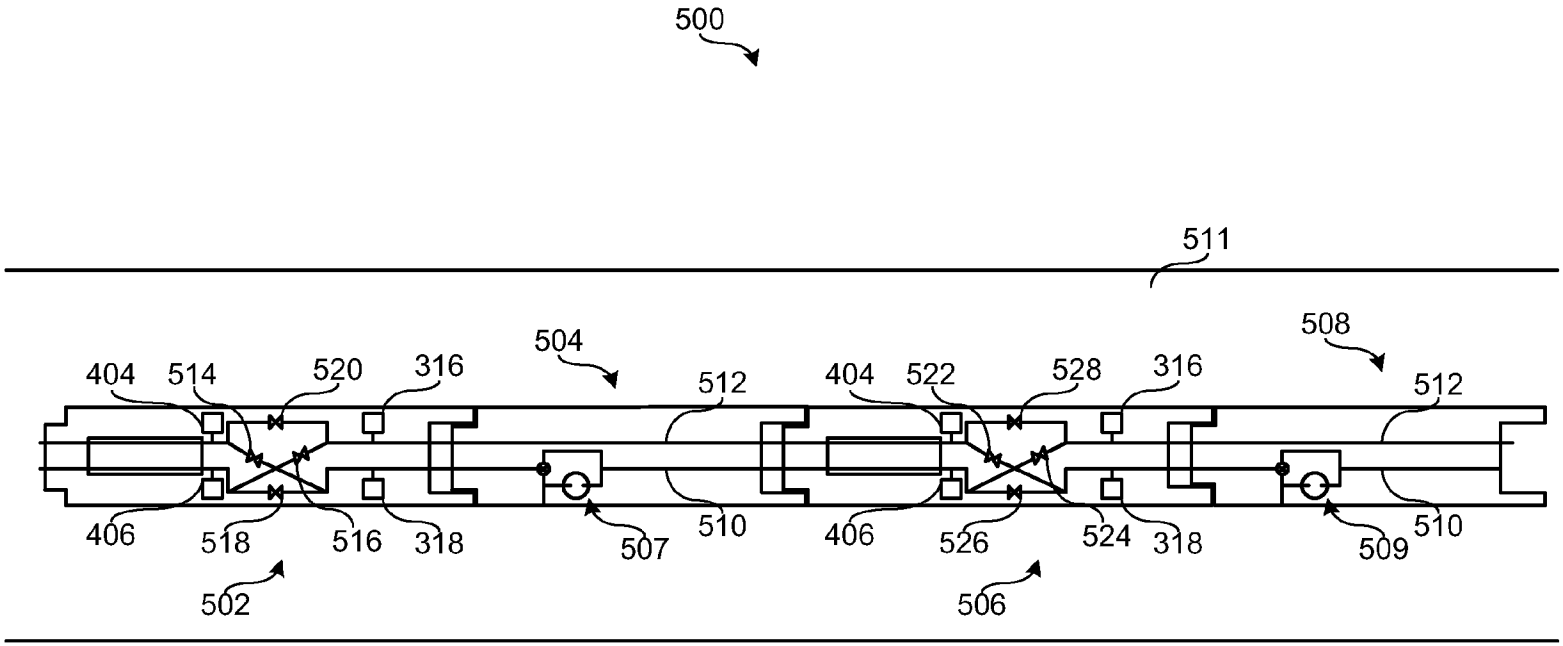

FIG. 5 depicts an example drillstring or wireline tool 500 that may be used to implement a portion of the drillstring 12 of FIG. 1A, the wireline tool 150 of FIG. 1B and/or the apparatus 200 of FIG. 2. The wireline tool 500 includes a first apparatus or module 502, a second module 504 (e.g., a pumpout module), a third apparatus or module 506 and a fourth module 508 (e.g., a pumpout module). The first module 502 and the third module 506 may each be substantially similar to the module 400 described in connection with FIG. 4. The pumpout modules 504 and/or 508 include respective pumps (e.g., reversible pumps) 507 and 509, are in fluid communication with a borehole 511 and may be utilized to, for example, flow fluid through a first flowline 510 and/or a second flowline 512 at a controlled flowing pressure and/or flowrate. Generally, positioning the modules 502, 504, 506 and 508 in such an arrangement enables the first flowline 510 or the second flowline 512 of the second module 504 or the fourth module 508 to be bypassed to enable a different one of the modules 504 or 508 to be utilized by actuating fluid valves 514-520 of the first module 502 and/or fluid valves 522-528 of the third module 506. In operation, the first module 502 and/or the third module 506 may be positioned in any suitable position along the wireline tool 500.

Figure 6:
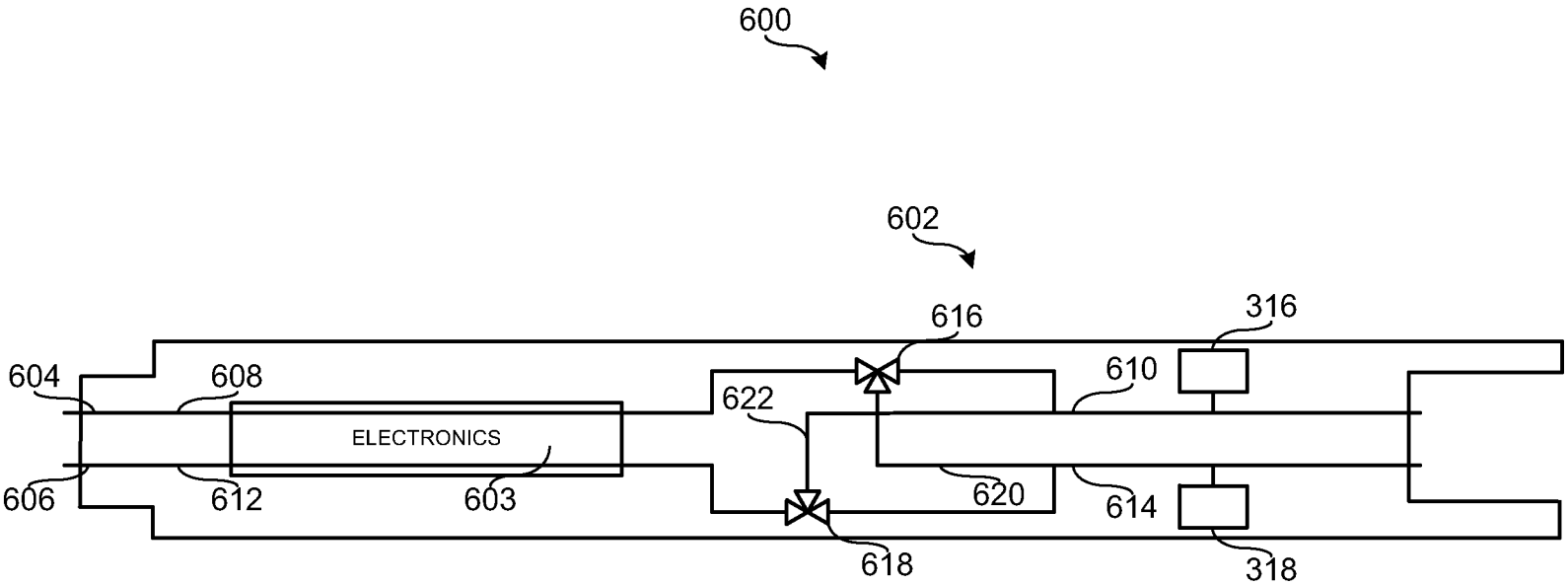

FIG. 6 depicts an example apparatus or module 600 of a drillstring or wireline tool 602 that may be used to implement at least a portion of the apparatus 200 of FIG. 2. The module 600 includes an electronics module 603 and a first flowline 604 and a second flowline 606 that extend through the module 600. The first flowline 604 and the second flowline 606 may be used to implement the first and second flowlines 206 and 208 of FIG. 2. The first flowline 604 includes a first portion 608 (e.g., an upstream portion) and a second portion 610 (e.g., a downstream portion) and, similarly, the second flowline 606 includes a first portion 612 (e.g., an upstream portion) and a second portion 614 (e.g., a downstream portion). The module 600 of FIG. 6 is substantially similar to the example module 300 of FIG. 3. However, the example module 600 of FIG. 6 includes a first fluid valve 616 (e.g., a three-way valve) and a second fluid valve 618 (e.g., another three-way valve) that are fluidly coupled to first and second junction flowlines 620 and 622 and to the second portions 610 or 614, respectively. Generally, the first junction flowline 620 enables fluid to flow from the first portion 608 of the first flowline 604 to the second portion 614 of the second flowline 606 and the second junction flowline 622 enables fluid to flow from the first portion 612 of the second flowline 606 to the second portion 610 of the first flowline 604.

Figure 7:
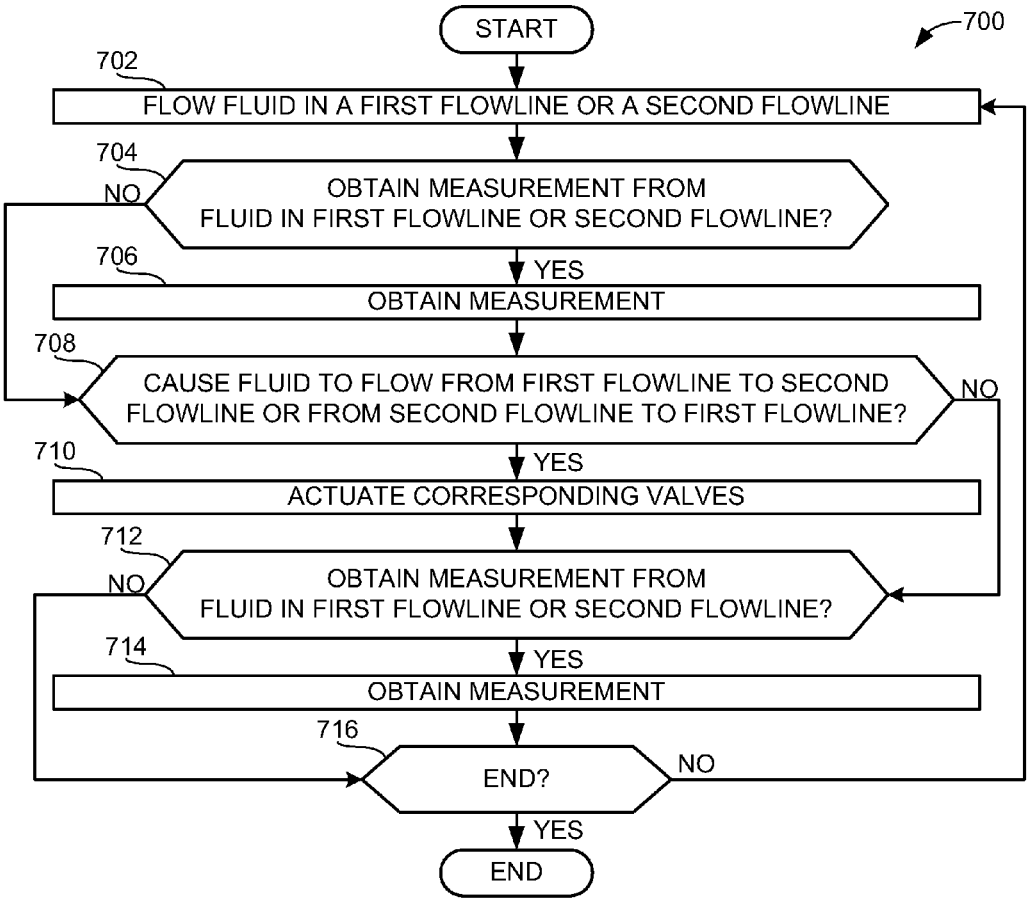
FIG. 7 is a flow diagram of an example method according to one or more aspects of the present disclosure.

FIG. 7 is a flowchart of an example method 700 that can be used in conjunction with the example apparatus described herein to control fluid flow in a downhole tool. The example method of FIG. 7 may be used to implement at least a portion of the drillstring 12 of FIG. 1A, a portion of the example wireline tool 150 of FIG. 1B, the apparatus 200 of FIG. 2, the example modules 300, 400 and/or 600 of FIGS. 3, 4, and 6 and/or the example wireline tool 500 of FIG. 5. The example method of FIG. 7 may be implemented using software and/or hardware. In some example implementations, the flowchart of FIG. 7 can be representative of example machine readable instructions, and the example method of the flowchart may be implemented entirely or in part by executing the machine readable instructions. Such machine readable instructions may be executed by the logging and control computer 145 (FIG. 1A), the electronics and processing system 156 (FIG. 1B), the downhole control system 164 (FIG. 1B) and/or the electronics modules 303 and/or 603 (FIGS. 3, 4, and 6). In particular, a processor or any other suitable device to execute machine readable instructions may retrieve such instructions from a memory device (e.g., a random access memory (RAM), a read only memory (ROM), etc.) and execute those instructions. In some example implementations, one or more of the operations depicted in the flowchart of FIG. 7 may be implemented manually. Although the example method 700 is described with reference to the flowchart of FIG. 7, persons of ordinary skill in the art will readily appreciate that other methods to implement at least the portion of the drillstring 12 of FIG. 1A, the portion of the wireline tool 150 of FIG. 1B, the apparatus 200 of FIG. 2, the example module 300, 400 and/or 600 of FIGS. 3, 4, and 6 and/or the example wireline tool 500 of FIG. 5 may additionally or alternatively be used. For example, the order of execution of the blocks depicted in the flowchart of FIG. 7 may be changed and/or some of the blocks described may be rearranged, eliminated, or combined.

Initially, the probe assembly 202 (FIG. 2) extracts (e.g., admits, draws, etc.) fluid from the formation F, which flows through the first portion 308 (FIGS. 3 and 4) or 608 (FIG. 6) of the first flowline 304 (FIGS. 3 and 4), 510 (FIG. 5) or 604 (FIG. 6) and/or the first portion 312 (FIGS. 3 and 4) or 612 (FIG. 6) of the second flowline 306 (FIGS. 3 and 4), 512 (FIG. 5) or 606 (FIG. 6) (block 702). As the fluid flows through the respective portions 308 (FIGS. 3 and 4), 312 (FIGS. 3 and 4), 608 (FIG. 6) and/or 612 (FIG. 6), the example method 700 determines whether or not to obtain a measurement from the fluid flowing in the first or second flowlines 304, 306, 510, 512, 604 and/or 606 (block 704) via, for example, one of the sensors 404 or 406 of FIG. 4. If the example method 700 determines that a measurement is to be obtained, control advances to block 706 and a measurement of a characteristic of the fluid is obtained (block 706). As discussed above, the sensors 404 or 406 (FIG. 4) and/or any of the sensors or fluid measurement devices described herein may be similarly or differently configured to measure the same or different fluid characteristic(s) such as, for example, pressure, drilling fluid density, formation fluid density, formation fluid viscosity, and/or drilling fluid viscosity of fluid. However, if the example method 700 determines that a measurement is not to be obtained, control advances to block 708.

The method 700 then determines whether or not to cause fluid to flow from the first portion 308 (FIGS. 3 and 4) or 608 (FIG. 6) of the first flowline 304 (FIG. 3), 510 (FIG. 5) or 604 (FIG. 6) to the second portion 314 (FIGS. 3 and 4) and/or 614 (FIG. 6) of the second flowline 306 (FIGS. 3 and 4), 512 (FIG. 5) or 606 (FIG. 6) or from the first portion 312 (FIGS. 3 and 4) or 612 (FIG. 6) of the second flowline 306 (FIGS. 3 and 4), 512 (FIG. 5) or 606 (FIG. 6) to the second portion 310 (FIGS. 3 and 4) of the first flowline 304 (FIG. 3), 510 (FIG. 5) or 604 (FIG. 6) (block 708). If the method 700 determines that fluid is to flow from the first flowline 304 (FIG. 3), 510 (FIG. 5) and/or 604 (FIG. 6) to the second flowline 306 (FIGS. 3 and 4), 512 (FIG. 5) or 606 (FIG. 6) or from the second flowline 306 (FIGS. 3 and 4), 512 (FIG. 5) or 606 (FIG. 6) to the first flowline (FIG. 3), 510 (FIG. 5) or 604 (FIG. 6), control advances to block 710 and one or more of the fluid valves 320, 322, 328, 330, 514-520, 522-528, 616 and/or 618 are actuated (block 710) to enable the fluid to flow from the first flowline 304 (FIG. 3), 510 (FIG. 5) or 604 (FIG. 6) to the second flowline 306 (FIGS. 3 and 4), 512 (FIG. 5) or 606 (FIG. 6) and/or from the second flowline 306 (FIGS. 3 and 4), 512 (FIG. 5) or 606 (FIG. 6) to the first flowline (FIG. 3), 510 (FIG. 5) or 604 (FIG. 6).

In some examples, the method 700 may decide to cause the fluid to flow from the first flowline 304 (FIG. 3), 510 (FIG. 5) or 604 (FIG. 6) to the second flowline 306 (FIGS. 3 and 4), 512 (FIG. 5) or 606 (FIG. 6) and/or from the second flowline 306 (FIGS. 3 and 4), 512 (FIG. 5) or 606 (FIG. 6) to the first flowline (FIG. 3), 510 (FIG. 5) or 604 (FIG. 6) because of an operational problem with one of the devices (e.g., one of the sensors 316, 318, 404, and/or 406), to bypass, for example, the second module 504 (FIG. 5) to enable use of the fourth module 508 (FIG. 5) and/or to enable a measurement of the fluid to be obtained from a sensor coupled to the other flowline 304 (FIG. 3) or 604 (FIG. 6) or 306 (FIGS. 3 and 4) or 606 (FIG. 6).

The example method 700 then determines whether or not another measurement from the fluid flowing in the first or second flowlines 304, 306, 604 and/or 606 (block 712) is to be obtained via, for example, one of the sensors 316, 318, 404 and/or 406. In some examples, the method 700 may determine whether or not to obtain another measurement based, at least in part, on the direction of fluid flow, the status of the fluid valve 320, 322, 328, 330, 514-520, 522-528, 616 and/or 618 and/or the flowline 304 (FIG. 3), 510 (FIG. 5) or 604 (FIG. 6), 306 (FIGS. 3 and 4), 512 (FIG. 5) or 606 (FIG. 6) to which the sensor 316, 318, 404 and/or 406 is coupled. If the example method 700 determines a measurement is to be obtained, control advances to block 714 and a measurement of a characteristic of the fluid is obtained (block 714). However, if the example method 700 determines that a measurement is not to be obtained, control advances to block 716 at which point the example method 700 determines whether or not to end the process (block 716).

Figure 8:
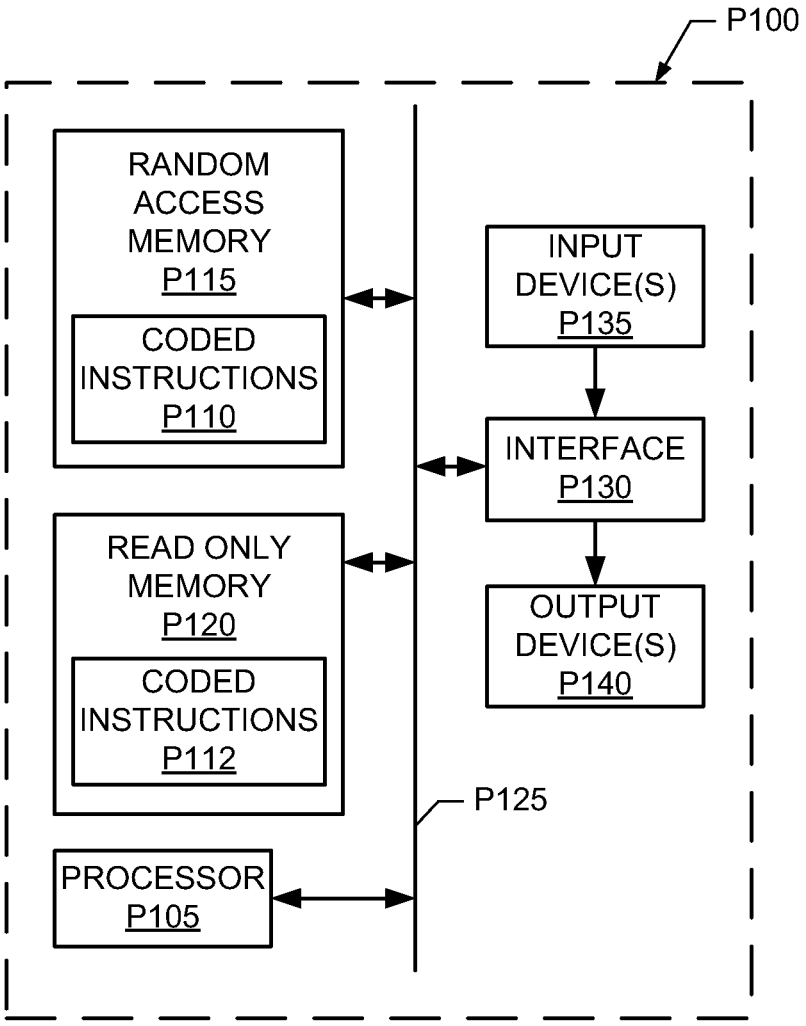
FIG. 8 is a schematic illustration of an example processor platform that may be used and/or programmed to implement any or all of the example methods and apparatus described herein.

FIG. 8 is a schematic diagram of an example processor platform P100 that may be used and/or programmed to implement the logging and control computer 145, the electronics and processing system 156 and/or the downhole control system 164. For example, the processor platform P100 can be implemented by one or more general purpose processors, processor cores, microcontrollers, etc.

The processor platform P100 of the example of FIG. 8 includes at least one general purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example methods and apparatus described herein.

The processor P105 is in communication with the main memory (including the ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

In view of the above and the figures, it would be clear that the present disclosure introduces a method of controlling fluid in a downhole tool that may include actuating a plurality of fluid valves to close a fluid path between first and second portions of a first flowline or close a fluid path between first and second portions of a second flowline. The first and second flowlines may be adjacent to each other within the downhole tool. Additionally, actuating the plurality of fluid valves may open a fluid path between the first portion of the first flowline and the second portion of the second flowline or open a fluid path between the first portion of the second flowline and the second portion of the first flowline.

The present disclosure also introduces an apparatus to control fluid flow in a downhole tool that may include a first fluid valve fluidly coupled between a first portion of a first flowline and a second portion of a second flowline and a second fluid valve fluidly coupled between a first portion of the second flowline and a second portion of the first flowline. Additionally, the example apparatus may include a third fluid valve fluidly coupled between the first and second portions of the first flowline and a fourth fluid valve fluidly coupled between the first and second portions of the second flowline. The first, second, third and fourth fluid valves may be controllable to cause fluid to flow from the first portion of the first flowline to the second portion of the second flowline or from the first portion of the second flowline to the second portion of the first flowline.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus comprising:

a downhole tool having an elongated body formed by a plurality of discrete modules coupled end-to-end, thus forming first and second flowlines each extending the collective length of the plurality of discrete modules, wherein a first one of the modules comprises a selectively extendable fluid admitting assembly to admit formation fluid into the first and second flowlines, wherein a second one of the modules comprises:

a first portion of the first flowline;

a second portion of the first flowline;

a first portion of the second flowline;

a second portion of the second flowline;

a first fluid valve fluidly coupled between the first portion of the first flowline and the second portion of the second flowline;

a second fluid valve fluidly coupled between the first portion of the second flowline and the second portion of the first flowline;

a third fluid valve fluidly coupled between the first and second portions of the first flowline; and a fourth fluid valve fluidly coupled between the first and second portions of the second flowline, wherein the first, second, third and fourth fluid valves are controllable to cause fluid to flow from the first portion of the first flowline to the second portion of the second flowline or from the first portion of the second flowline to the second portion of the first flowline; and wherein the second module does not comprise means for direct fluid communication with the formation, wherein a third one of the modules comprises a first pump, and wherein a fourth one of the modules comprises a second pump.

2. The apparatus of claim 1 wherein the first, second, third and fourth fluid valves are further controllable to cause the fluid to flow between the first and second portions of the first flowline or the first and second portions of the second flowline.

3. The apparatus of claim 1 wherein at least one of the fluid valves is a two-way valve.

4. The apparatus of claim 1 wherein each of the fluid valves is electrically or hydraulically controllable.

5. The apparatus of claim 1 further comprising a first sensor coupled to the first flowline and a second sensor coupled to the second flowline.

6. The apparatus of claim 5 wherein the first, second, third and fourth fluid valves are controllable to enable the first sensor to obtain a measurement from fluid flowing from the first portion of the second flowline and to enable the second sensor to obtain a measurement from fluid flowing from the first portion of the first flowline.

7. The apparatus of claim 1 further comprising a plurality of sensors coupled to the first flowline and a plurality of sensors coupled to the second flowline.

8. An apparatus, comprising:

a plurality of discrete modules coupled end-to-end to form at least a portion of a downhole tool having first and second flowlines each extending the collective length of the plurality of discrete modules;

a first fluid valve disposed within a first module of the plurality of discrete modules, wherein the first module comprises first and second portions of the first flowline and first and second portions of the second flowline, wherein the first portion of the first flowline is upstream or downstream relative to the second portion of the second flowline, and wherein the first fluid valve is coupled between the first portion of the first flowline and the second portion of the second flowline; and a second fluid valve disposed within the first module and coupled between the second portion of the first flowline and the first portion of the second flowline, wherein the second portion of the first flowline is upstream or downstream relative to the first portion of the second flowline, and wherein the first and second fluid valves are controllable to cause fluid to flow between the first portion of the first flowline and the second portion of the second flowline or between the first portion of the second flowline and the second portion of the first flowline;

wherein the first module can fluidly communicate only with an adjacent one of the plurality of modules, wherein a third one of the modules comprises a first pump, and wherein a fourth one of the modules comprises a second pump.

9. The apparatus of claim 8 wherein the first fluid valve is further coupled between the first and second portions of the first flowline.

10. The apparatus of claim 8 wherein the second fluid valve is further coupled between the first and second portions of the second flowline.

11. The apparatus of claim 8 wherein at least one of the first fluid valve or the second fluid valve is a three-way valve.

12. The apparatus of claim 8 further comprising a third fluid valve coupled between the first and second portions of the first flowline and a fourth fluid valve coupled between the first and second portions of the second flowline, wherein the first module comprises the third and fourth fluid valves.

13. An apparatus for use with a drillstring, comprising:

a plurality of discrete modules coupled end-to-end, thereby forming first and second flowlines each extending the collective length of the plurality of discrete modules, wherein each of the plurality of discrete modules comprises a body that surrounds corresponding portions of each of the first and second flowlines;

wherein a first module of the plurality of discrete modules comprises a plurality of fluid flow valves to control a flow of fluid through and between the first and second flowlines, wherein actuating one or more of the plurality of fluid flow valves causes fluid flowing in an upstream portion of the first flowline to flow through a downstream portion of the second flowline;

wherein the first module is not configured to:

selectively seal off or isolate selected portions of a wellbore wall;

fluidly couple directly to a subterranean formation; or draw a fluid sample directly from the subterranean formation; and wherein a second module of the plurality of discrete modules is configured to:

selectively seal off or isolate a selected portion of the wellbore wall;

fluidly couple directly to the subterranean formation; and draw a fluid sample directly from the subterranean formation, wherein a third module of the plurality of discrete modules comprises a first pump, and wherein a fourth module of the plurality of discrete modules comprises a second pump.

14. The apparatus of claim 13 wherein actuating one or more of the plurality of fluid flow valves further causes fluid flowing in an upstream portion of the second flowline within the first module to flow through a downstream portion of the first flowline within the first module.

15. The apparatus of claim 13 wherein at least one of the plurality of fluid flow valves is a two-way valve.

16. The apparatus of claim 13 wherein at least one of the plurality of fluid flow valves is a three-way valve.

17. The apparatus of claim 13 further comprising a first sensor coupled to the first flowline within the first module and a second sensor coupled to the second flowline within the first module.

18. The apparatus of claim 17 wherein the plurality of fluid flow valves are controllable to enable a measurement to be obtained from either the first sensor or the second sensor from fluid flowing from the upstream portion of the first flowline within the first module.

19. The apparatus of claim 17 wherein the plurality of fluid flow valves are controllable to enable a measurement to be obtained via the first sensor from fluid flowing from an upstream portion of the second flowline to a downstream portion of the first flowline within the first module.

20. The apparatus of claim 17 wherein the plurality of fluid flow valves are controllable to enable a measurement to be obtained via the second sensor from fluid flowing from the upstream portion of the first flowline to the downstream portion of the second flowline within the first module.

21. The apparatus of claim 17 further comprising a plurality of sensors coupled to the first flowline within the first module and a plurality sensors coupled to the second flowline within the first module.

22. A method, comprising:

forming at least a portion of a downhole tool by coupling a plurality of discrete modules end-to-end, thereby forming a first flowline and a second flowline each extending the collective length of the plurality of discrete modules, wherein the plurality of discrete modules comprises a first module and a second module;

conveying the downhole tool within a wellbore to a subterranean formation penetrated by the wellbore;

selectively admitting fluid from the subterranean formation into the first module of the downhole tool; and actuating a plurality of fluid valves of the second module of the downhole tool to:

close a fluid path between first and second portions of the first flowline within the second module or close a fluid path between first and second portions of the second flowline within the second module; and open a fluid path between the first portion of the first flowline and the second portion of the second flowline within the second module or open a fluid path between the first portion of the second flowline and the second portion of the first flowline within the second module, wherein the plurality of discrete modules comprises a third module and a fourth module, wherein the third module comprises a first pump, wherein the fourth module comprises a second pump, and wherein actuating the plurality of fluid valves comprises bypassing the first pump of the third module to enable use of the second pump of the fourth module.

23. The method of claim 22 further comprising actuating the plurality of fluid valves in response to detecting an operational problem with a device coupled to the first flowline or the second flowline.

24. The method of claim 22 further comprising actuating the plurality of fluid valves in the downhole tool to enable a measurement of a characteristic of fluid flowing through the fluid path between the first portion of the first flowline and the second portion of the second flowline via a sensor coupled to the second portion of the second flowline.

25. The method of claim 22 further comprising actuating the plurality of fluid valves in the downhole tool to enable a measurement of a characteristic of fluid flowing through the fluid path between the first portion of the second flowline and the second portion of the first flowline via a sensor coupled to the second portion of the first flowline.

* * * * *